US009186553B2

(12) United States Patent
Eckert

(10) Patent No.: US 9,186,553 B2
(45) Date of Patent: Nov. 17, 2015

(54) MULTI-PURPOSE TOOL

(71) Applicant: William Eckert, Wesley Chapel, FL (US)

(72) Inventor: William Eckert, Wesley Chapel, FL (US)

( * ) Notice: Subject to any disclaimer, the term of this patent is extended or adjusted under 35 U.S.C. 154(b) by 264 days.

(21) Appl. No.: 14/020,220

(22) Filed: Sep. 6, 2013

(65) Prior Publication Data

US 2015/0067968 A1 Mar. 12, 2015

(51) Int. Cl.
*A63B 29/02* (2006.01)
*F16B 45/00* (2006.01)

(52) U.S. Cl.
CPC ..... *A63B 29/02* (2013.01); *A63B 2210/50* (2013.01)

(58) Field of Classification Search
CPC .... A63B 29/00; A63B 29/02; A63B 2210/50; F16B 45/00; F16B 45/02
USPC ..... 7/168, 161; 294/81.1, 82.2, 106, 66.1
See application file for complete search history.

(56) References Cited

U.S. PATENT DOCUMENTS

| | | | | |
|---|---|---|---|---|
| 1,295,076 | A * | 2/1919 | Sherman et al. | 294/66.1 |
| 4,133,569 | A * | 1/1979 | Pavack et al. | 294/106 |
| 6,079,761 | A * | 6/2000 | Sadeck | 294/82.1 |
| 7,240,937 | B2 * | 7/2007 | Wooten et al. | 294/82.1 |
| 2005/0073161 | A1 * | 4/2005 | Philbin | 294/82.1 |
| 2015/0067968 | A1 * | 3/2015 | Eckert | 7/168 |

* cited by examiner

*Primary Examiner* — Hadi Shakeri
(74) *Attorney, Agent, or Firm* — Gulf Coast Intellectual Property Group

(57) ABSTRACT

A utility tool configured to be transportable and operable to perform a variety of tasks. The utility tool includes a body that is generally cylindrical in shape and rigid in manner. The body includes a first end and a second end with an aperture formed into the body proximate said first end. Four slots are integrally formed into the body having an interior volume an extending from said second end towards the first end but not completely thereto. The utility tool further includes pivotally mounted arm members having a first position and a second position. The second end is configured to be removable and further functions to bias against a portion of the arm members to hold in their first and/or second positions. A plurality of recesses are integrally formed with the body proximate the second end.

4 Claims, 3 Drawing Sheets

MULTI-PURPOSE TOOL

FIELD OF THE INVENTION

The present invention relates generally to utility tools, more specifically but not by way of limitation, a multi-purpose utility tool that is adaptable to perform a variety of tasks such as but not limited to mine wire discovery, grappling hook for climbing and/or securing of a object.

BACKGROUND

There are on the market today many tools that exist for hikers, campers and military personnel that are designed to perform more than one task. Typically these tools try to combine the ability to perform certain task such as but not limited to digging and chopping. The object of the multipurpose tool is to provide a user the ability to carry one tool as opposed to several and further to provide a multipurpose tool that is compact and lightweight. While a desirable tool is compact and lightweight, it should be constructed with sufficient strength to withstand rugged use. Furthermore a multipurpose tool for users such as military personnel should be manufactured such that it requires little or no assembly and maintenance.

Specific tactical use tools should be designed so as to facilitate speed of use as well as reduce the number of times the tool is used to complete a specific task. A well-designed tactical tool should require relatively little training and increase the success ratio of the user performing the task. By way of example but not limitation, during specialized tactical operations, personnel may explore an area for mines by attempting to discover mine trip wires that may be dispersed in an area that requires entry by tactical personnel. Currently there are many methods and devices that are used in order to facilitate the discovery of mine trip wires. One issue with existing devices is their design lacks in promoting a desired stealth during completion of the task. As will be appreciated, the aforementioned operation is a task in which the user desires to make fewer throws of a device and subsequent drags thereof through an area in order to decrease the opportunity of being detected or for the sake of speed in identifying whether an area is safe.

Another issue with existing multi-purpose tools is their lack of configurability. While many existing multi-purpose tools are configured to adapt to perform two tasks, existing devices are typically not configured to allow a user to enhance the tool with an additional component so as to improve the ability to perform one of its intended tasks. More specifically but not by way of limitation, altering the weight distribution in the field of a tool so as to improve the ability of the tool for a specific purpose.

Accordingly, there is a need for a multipurpose tool that is compact and lightweight that is operable to facilitate the performance of more than one task wherein the tool is further configurable in the field in an efficient manner so as to improve the execution of at least one the intended uses of the multipurpose tool.

SUMMARY OF THE INVENTION

It is the object of the present invention to provide a multipurpose tool that is operable to perform a plurality of tasks that includes a generally cylindrical body.

Another object of the present invention is to provide a multipurpose tool operable to facilitate the execution of a plurality of tasks wherein the body includes at least one end portion that is removable.

A further object of the present invention is to provide a multipurpose tool operable to assist a user in performing a variety of tasks that includes a plurality of collapsible arms movably secured to the body.

Yet another object of the present invention is to provide a multipurpose tool operable to facilitate the execution of a plurality of tasks wherein the body further includes an aperture distal to the removable end portion of the body configured to provide an interface for attaching an object such as but not limited to a line.

An additional object of the present invention is to provide a multipurpose tool operable to assist a user in the execution of a plurality of tasks that is further configurable so as to alter the weight distribution thereof.

Still a further object of the present invention is to provide a multipurpose tool that is designed to facilitate the execution of several tasks wherein the collapsible arms include a surface having gripping teeth disposed thereon.

Another object of the present invention is to provide a multipurpose tool that is durable, lightweight and compact.

To the accomplishment of the above and related objects the present invention may be embodied in the form illustrated in the accompanying drawings. Attention is called to the fact that the drawings are illustrative only. Variations are contemplated as being a part of the present invention, limited only by the scope of the claims.

BRIEF DESCRIPTION OF THE DRAWINGS

A more complete understanding of the present invention may be had by reference to the following Detailed Description and appended claims when taken in conjunction with the accompanying Drawings wherein:

DETAILED DESCRIPTION

Figure 1:
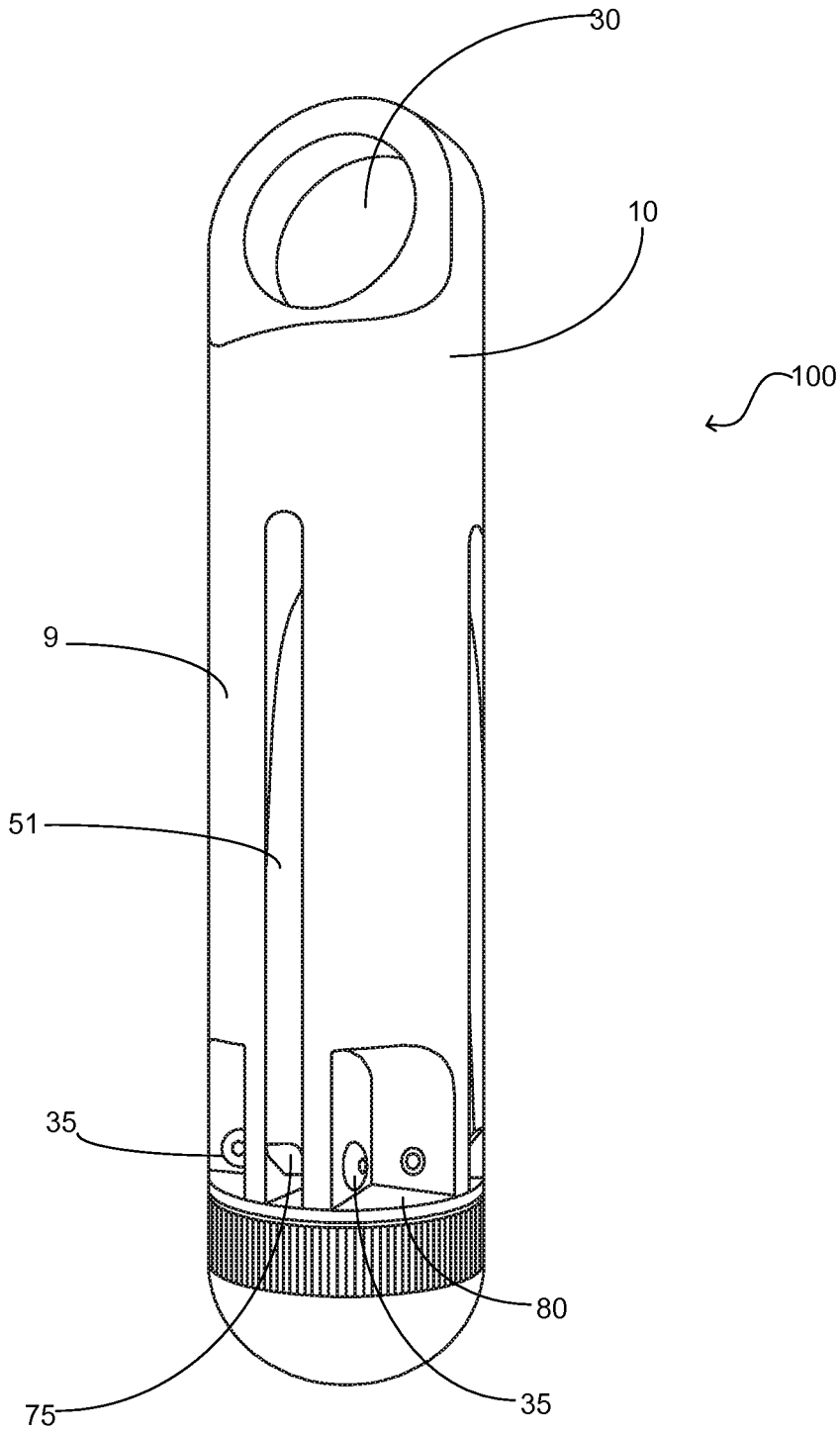
FIG. 1 is a perspective view of the preferred embodiment of the present invention with the arm members in a closed position.

Referring now to the drawings submitted herewith, wherein various elements depicted therein are not necessarily drawn to scale and wherein through the views and figures like elements are referenced with identical reference numerals, there is illustrated a utility tool 100 constructed according to the principles of the present invention.

Figure 2:
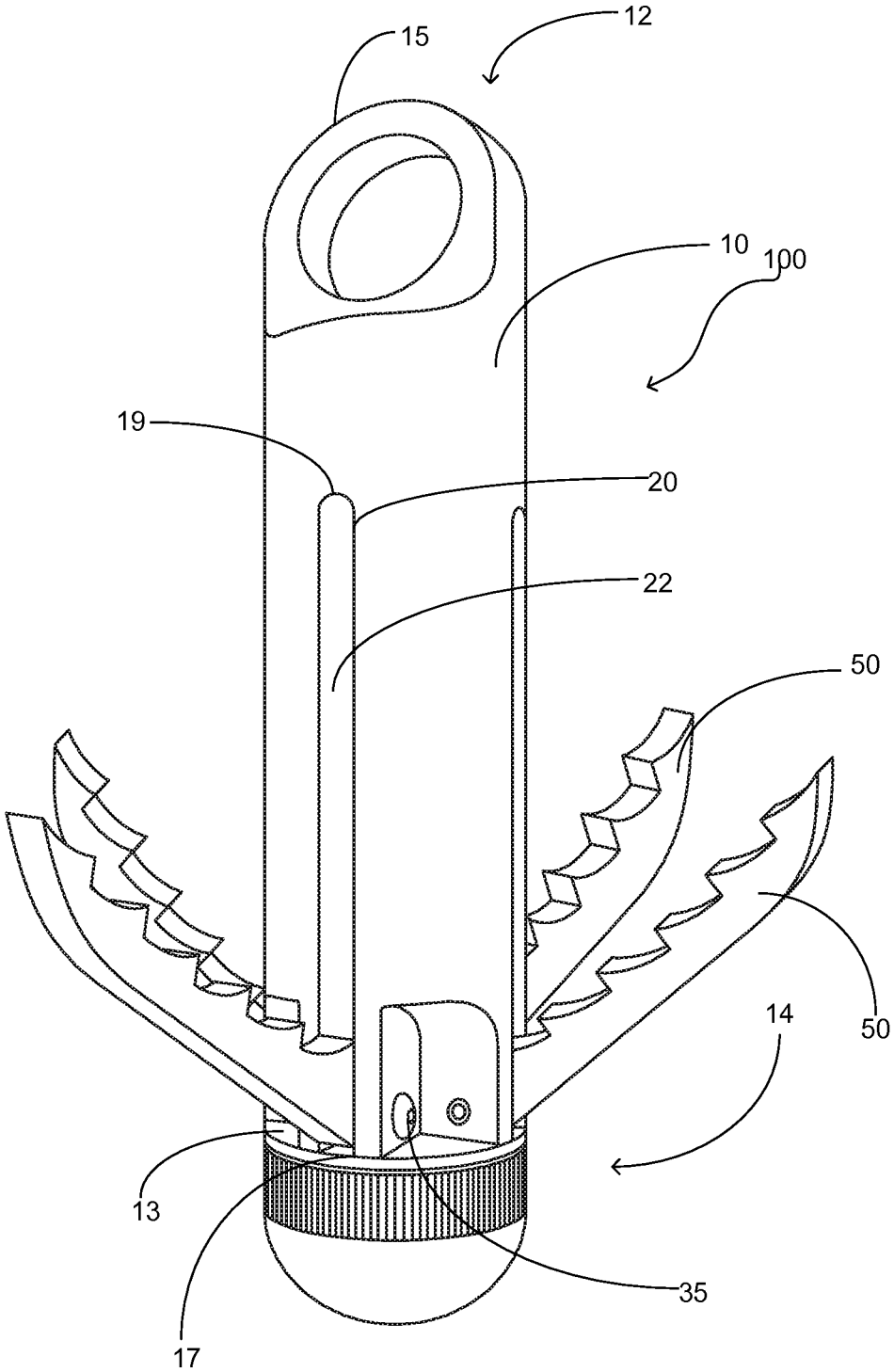
FIG. 2 is a perspective view of the preferred embodiment of the present invention with the arm members in an open position.

Referring in particular to FIGS. 1 and 2, the utility tool 100 further includes a body 10. The body 10 is generally cylindrical in shape and is manufactured from a suitable durable material such as but not limited to metal. The cylindrical shape of the body 10 aids in the ease of deployment and storage of the utility tool 100. While the body 10 is cylindrical in shape in its preferred embodiment, it is contemplated within the scope of the present invention that the body 10 could be formed in numerous different shapes. The body 10 includes a first end 12 and a second end 14. The first end 12 includes an outer edge 15 that is generally arcuate in shape. The arcuate shape of the outer edge 15 assists in performing some of the tasks for which the utility tool 100 can be utilized to perform. By way of example but not by way of limitation, as a user deploys the utility tool 100 on a ground surface to search for mine trip wires or the like, the shape of the outer edge 15 provides decreased resistance during retrieval of the utility tool 100 by the user. While in its preferred embodiment, the outer edge 15 is generally arcuate in manner, it is further contemplated within the scope of the present invention that the outer edge 15 could be formed in numerous other shapes.

Integrally formed in the body 10 are a plurality of slots 20. The slots 20 are generally rectangular in shape having an interior volume being operable to store the arm members 50 in their first position. The slots 20 extend from point 13 proximate the second end 14 towards the first end 12. The slots 20 include a first end 17 and a second end 19 with the second end 19 being rounded in manner. It is contemplated within the scope of the present invention that the depth of the interior volume 22 of the slots 20 are sufficient so as to allow the rear edge 51 of the arm members 50 to be substantially aligned with the surface 9 of the body 10. This depth of the interior volume 22 of the slots facilitates improved storage and retrieval of the utility tool 100 by reducing the opportunity for a protruded rear edge 51 to bind against a surface of a storage compartment of a backpack or similar structure. The slots 20 are equally distributed around the circumference of the body 10. By way of example but not by way of limitation, the preferred embodiment of the utility tool 100 has four slots 20 operable to accommodate four arm members 50. The four slots 20 are generally spaced ninety degrees apart from each other around the body 10. The equilateral spacing of the slots 20 and as such the arm members 50 facilitates an improved engagement of the arm members 50 with the desired target. While in the preferred embodiment the utility tool 100 has four slots 20 and arm members 50, it is further contemplated within the scope of the present invention that the utility tool 100 could be constructed with as few as one slot 20 and arm member 50 or a quantity greater than four so as to be adapted for various applications.

Integrally formed with the first end is aperture 30. Aperture 30 functions to provide an interface to allow the utility tool 100 to be coupled to a retrieval line, wire or other similar item. For most of the applications contemplated for the utility tool 100, the utility tool 100 is thrown towards a target and then retrieved by the user. A line or similar item is operably coupled to the aperture 30 so as to facilitate the retrieval of the utility tool 100 subsequent its deployment. While no particular size is required for the aperture 30, good results have been achieved by utilizing an aperture 30 within the range of one-half to one inch in diameter.

Still referring to FIGS. 1 and 2, the arm members 50 are illustrated in a first position and a second position respectively. The arm members 50 are pivotally secured to the body 10 using fasteners 35. Those skilled in the art will recognize that numerous types of fasteners could be utilized to pivotally secure the arm members 50 to the body 10. It is contemplated within the scope of the present invention that the fasteners 35 are removable so as to facilitate the easy replacement of an arm member 50. The body 10 includes a recess 40 proximate the second end 14 intermediate each slot 20 so as to facilitate access to each fastener 35. The recesses 40 are of suitable size so as to accommodate a tool bit such as but not limited to a screwdriver.

Figure 4:
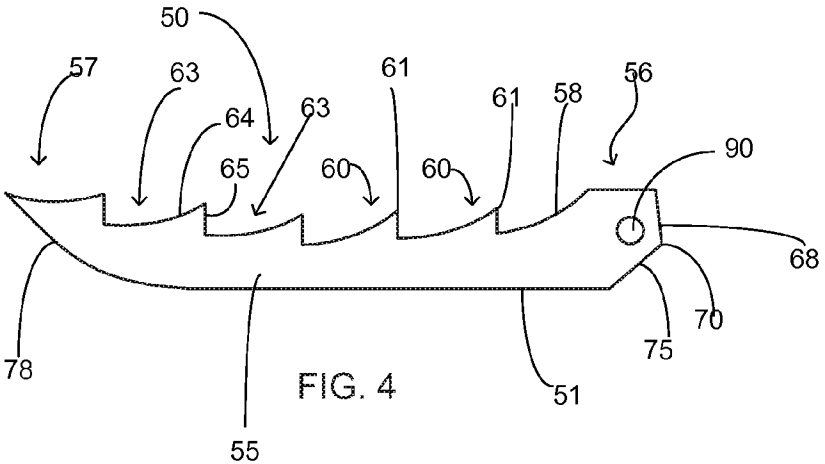
FIG. 4 is a detailed view of an arm member of the present invention.

Illustrated in FIG. 4 is a detailed view of an arm member 50. As previously mentioned herein, the arm members 50 have a first position and a second position wherein the arm members 50 are disposed within the interior volume 22 of the slots 20 in the first position and are extended outward from the body 10 in the second position. The arm members 50 include a body 55 that is generally planar in manner and constructed from a suitable durable material such as but not limited to metal. The body 55 includes a first end 56 and a second end 57. Formed along the inner surface 58 of the body 55 are a plurality of teeth 60. Each of the teeth 60 has a distal end 61 extending away from the body 55. The valleys 63 are intermediate each of the teeth 60 and are defined by the first side 64 and second side 65 of the teeth 60. The angle of the first side 64 is less than the angle of the second side 65 with those angles being measured with respect to a plane normal to the rear edge 51. The second side 65 has an angle of approximately 90 degrees. This angle assists in the operable engagement of the teeth 60 with a desired target such as but not limited to a mine trip wire. Proximate the first end 56 is the inner edge 68. The inner edge 68 is slightly angular in orientation so as to ensure the arm member 50 is substantially disposed within its respective slot 20 in its first position. The angle of the inner edge 68 is approximately one to four degrees with the angle being measured with respect to a plane normal to corner 70. While a two to four degree angle of the inner edge 68 is preferred, it is further contemplated within the scope of the present invention that various different angles for the inner edge 68 could be utilized to achieve the desired function as described herein. The rear edge 51 includes a first portion 75 proximate the first end 56. The first portion 75 is angular in orientation such that the angle of the first portion 75 is approximately thirty to forty degrees wherein the angle being measured with respect to a plane normal to the rear edge 51. This angle of the first portion of the rear edge 51 facilitates proper opening of the arm members 50 in their second position such that the arm members 50 are extended sufficiently outward from the body 10. The first portion 75 is biased against the inner surface 80 of the washer 85 subsequent the arm members 50 being placed in their second position. A hole 90 is located proximate the first end 56. The hole 90 functions to receive therethrough the fastener and facilitate the pivotal securing of the arm member 50.

Proximate the second end 57 of the arm member 50, the rear edge 51 includes a second portion 78 that is arcuate in manner. The second portion 78 of the rear edge 51 defines the shape of the second end 57 of the arm member 50. The arcuate shape of the second end 57 improves the grasping ability of the arm members 50 for some applications. While no particular radius of the second portion 78 is required, good results have been achieved by utilizing a radius of 1⅛ inches to 1½ inches.

Figure 5:
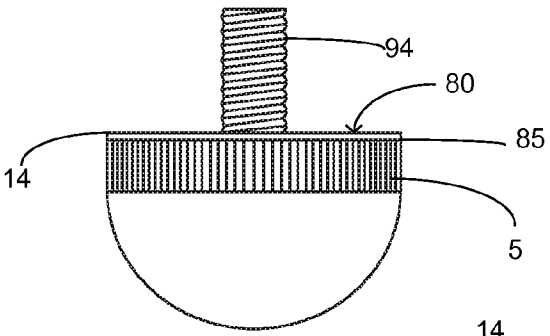
FIG. 5 is a detailed view of the removable end of the present invention.

Referring in particular to FIG. 5, a detailed view of the second end 14 is illustrated therein. The second end 14 is removable and releasably secured to the body 10. The second end is generally dome-shaped and is manufactured from a suitable durable material such as but not limited to metal. The second end 14 further includes a knurled surface 5 that is circumferentially disposed operable to provide an improved grasp of the second end 14. The second end 14 has integrally formed therewith a bolt 94. The bolt 94 functions to releasably secure the second end 14 to the body 10 wherein the bolt is mateably threaded into cavity 105 (see FIG. 3). Those skilled in the art will recognize that numerous different diameters and lengths of the bolt 94 could be utilized. The second end 14 includes at least one washer 85. The washer 85 is removably secured to the second end 14 such that the bolt 94 is journaled therethrough and the washer 85 is adjacent the inner edge 101 of the second end 14. The washer 85 is operable to receive the first portion 75 of the arm member 50 as previously described herein and further functions to provide the ability to alter the weight of the body 10 so as to provide a heavier weight distribution towards the second end 14. It is contemplated within the scope of the present invention that the washer 85 is manufactured from a dense metal such as but not limited to tungsten or osmium. It is additionally contemplated within the scope of the present invention that the bolt 94 is of sufficient length in order to accommodate a plurality of washers 85. This configurability allows a user to adjust the weight distribution towards the second end 14 for a particular application. Those skilled in the art will recognize that numerous types of materials could be utilized to manufacture the washers 85 to achieve the desired objective identified herein.

Figure 3:
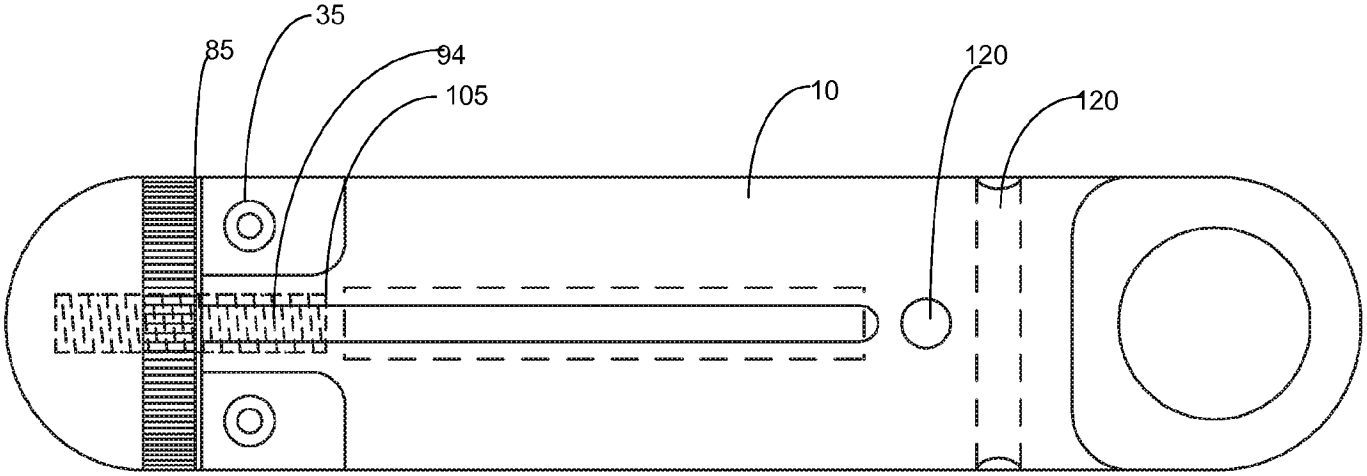
FIG. 3 is a cross-sectional diagram of the present invention.

Referring in particular to FIG. 3, a cross-sectional diagram of the utility tool 100 is illustrated therein. It is contemplated within the scope of the present invention that the body 10 could have one or more ballast compartments 120. The ballast compartments 120 are generally hollow and operable to receive therein a dense material such as but not limited to lead. The ballast compartments 120 provide the ability for a user to alter the weight distribution of the body 10 for a desired application. It is contemplated within the scope of the present invention that the body 10 could have various quantities of ballast compartments 120.

Referring to FIGS. 1 and 2, a description of the operation of the utility tool 100 is as follows. In use, a user will transport the utility tool 100 in a desired storage compartment with the arm members 50 in their first position. Upon requirement of deployment of the utility tool 100, the user will loosen the second end 14 so as to release the arm members 50 into their second position. The second end is subsequently retightened so as to bias against the first portion 75 securing the arm members 50 in their second position. With a line or similar item operably coupled to the aperture 30, the utility tool as hurled in a desired direction. In the exemplary use of mine trip wire discovery, the utility tool 100 is then retrieved by the user via the line. During retrieval, the arm members 50 at least partially penetrate the soil in order to facilitate discovery of a mine trip wire or other item. As discussed herein a plurality of washers 85 can be releasably secured intermediate the body 10 and the second end 14 so as alter the weight distribution towards the second end 14 in order to facilitate the improved engagement of the arm members 50 with the soil during retrieval.

In the preceding detailed description, reference has been made to the accompanying drawings that form a part hereof, and in which are shown by way of illustration specific embodiments in which the invention may be practiced. These embodiments, and certain variants thereof, have been described in sufficient detail to enable those skilled in the art to practice the invention. It is to be understood that other suitable embodiments may be utilized and that logical changes may be made without departing from the spirit or scope of the invention. The description may omit certain information known to those skilled in the art. The preceding detailed description is, therefore, not intended to be limited to the specific forms set forth herein, but on the contrary, it is intended to cover such alternatives, modifications, and equivalents, as can be reasonably included within the spirit and scope of the appended claims.

What is claimed is:

1. A utility tool comprising:

a body, said body being elongated in manner, said body having a first end and a second end, said second end configured to be releasably secured to said body, said body having an aperture, said aperture being disposed proximate said first end of said body, said body being manufactured from a rigid material;

at least one slot, said at least one slot having an interior volume, said at least one slot extending from proximate said second end towards said first end; and at least one arm member, said at least one arm member being pivotally mounted to said body, said at least one arm member having a first position and a second position, said at least one arm member being substantially disposed within the interior volume of said slot in said first position, said at least one arm member extended outward from said body in said second position, said at least one arm member having a first end and a second end, said first end of said at least one arm member having a radius of 1 and ⅛ inch to 1 and ½ inch, said at least one arm member including an inner surface, said inner surface having a plurality of teeth, said plurality of teeth having a first side and a second side, said plurality of teeth operable to provide gripping of an object, said at least one arm member further including a rear edge, said rear edge further including a first portion, said first portion being angular in manner, said first portion operable to control the outward angular position of said at least one arm member in said second position;

a recess, said recess integrally formed with said body proximate said second end, said recess operable to provide access to a fastener, said fastener being operable to releasably secure said at least one arm member; and at least one washer, said washer being intermediate said second end and said body, said at least one washer operable to alter the weight distribution of said utility tool such that the utility tool has a larger percentage of weight towards said second end.

2. A multi-purpose tool comprising:

a body, said body being generally cylindrical in shape, said body having a first end and a second end, said second end being releasably secured to said body, said second end being dome shaped, said body being rigid in manner, said body further including a plurality of slots, said plurality of slots being generally rectangular in shape, said plurality of slots extending from said second end towards said first end but not completely thereto, said plurality of slots having an interior volume;

a plurality of arm members, said plurality of arm members being pivotally mounted to said body, said plurality of arm members having a first position and a second position, said plurality of arm members being disposed within said plurality of slots in said first position, said plurality of arm members having an inner surface and a rear edge, said inner surface having a plurality of teeth formed thereon, said plurality of arm members having a first end and a second end, said first end of said plurality of arm members having a radius of 1 and ⅛ inch to 1 and ½ inches, said plurality of arm members configured to be outwardly angled away from said body in said second position of said plurality of arm members, wherein said rear edge of said plurality of arm members further includes a first portion said first portion being angular in manner, said first portion operable to be biased against said second end of said body subsequent said plurality of arm members being moved to said second position, said first portion operable to control the outward angle of said plurality of arm members, said plurality of arm members further including an inner edge, said inner edge proximate said second end of said plurality of arm members, said inner edge being angular in manner, said inner edge operable to be biased against said second end of said body during said plurality of arm members being in said first position;

a plurality of recesses, said plurality of recesses integrally formed with said body proximate said second end, said plurality of recesses operable to provide access to a fastener securing said plurality of arm members; and at least one washer, said at least one washer being intermediate said second end and said body, said at least one washer being manufactured from a denser material than said body so as to alter the weight distribution of said body towards said second end.

3. The multi-purpose tool as recited in claim 2, wherein said body further includes an aperture, said aperture being disposed proximate said first end of said body.

4. A utility tool configured to be transportable and operable to perform a variety of tasks comprising:

a body, said body being generally cylindrical in shape, said body having a first end and a second end, said first end further including an aperture, said second end being releasably secured to said body, said second end being dome shaped, said body being rigid in manner, said body further including four slots, said four slots being generally rectangular in shape, said four slots extending from said second end towards said first end but not completely thereto, said four slots having an interior volume, said four slots being equitably distributed around the circumference of said body, said body further including four recesses, said four recesses being integrally formed into said body, said four recesses being intermediate said four slots; and four arm members, said four arm members being pivotally mounted to said body, said four arm members having a first position and a second position, said four arm members being disposed within said four of slots in said first position, said four arm members having an inner surface and a rear edge, said rear edge of said four arm members having a first portion, said first portion of said rear edge being angular in manner, said first portion of said rear edge operable to be biased against said second end of said body subsequent said four arm members being moved to said second position, said first portion operable to control the outward angle of said four arm members, said first portion having an angle range of thirty to forty degrees, said inner surface having a plurality of teeth formed thereon, said teeth having a first side and a second side, said first side of said teeth having an angle that is less than that of said second side with respect to said rear edge, wherein said first side of said plurality of teeth have an angle of approximately 90 degrees with respect to said rear edge of said four arm members, said four arm members having a first end and a second end, said second end further including a corner, said first end of said four arm members having a radius of 1 and ⅛ inch to 1 and ½ inches said four arm members further including a hole proximate said second end, said hole operable to receive a fastener for the pivotal securing of said four arm members, said four arm members configured to be outwardly angled away from said body in said second position of said four of arm members, said four arm members having an inner edge, said inner edge proximate said second end of said plurality of arm members said inner edge being angular in manner, said inner edge operable to be biased against said second end of said body during said four arm members being in said first position, said inner edge being constructed to have an angle range between 1 to 4 degrees with respect to a plane normal to said corner;

at least one washer, said at least one washer being intermediate said second end and said body, said at least one washer being manufactured from a denser material than said body so as to alter the weight distribution of said body towards said second end.

* * * * *